US005950745A

United States Patent [19]

Ingmarsson

[11] Patent Number: 5,950,745

[45] Date of Patent: Sep. 14, 1999

[54] DIAMOND-COATED BUTTON INSERT FOR DRILLING

[75] Inventor: Karl Ingmarsson, Houston, Tex.

[73] Assignee: Sandvik AB, Sandviken, Sweden

[21] Appl. No.: 08/912,562

[22] Filed: Aug. 18, 1997

[51] Int. Cl.[6] ..... E21B 10/46

[52] U.S. Cl. ..... 175/420.2; 175/434

[58] Field of Search ..... 175/420.2, 430, 175/434, 426

[56] References Cited

U.S. PATENT DOCUMENTS 4,724,913 2/1988 Morris ..... 175/430

5,332,051 7/1994 Knowlton ..... 175/430

5,740,874 4/1998 Matthias ..... 175/430

5,743,346 4/1998 Flood et al. ..... 175/420.2

*Primary Examiner*—William Neuder

*Attorney, Agent, or Firm*—Burns, Doane, Swecker & Mathis, L.L.P.

[57] ABSTRACT

A button insert for a percussive drill bit comprises a carbide base and a diamond layer bonded thereto. The diamond layer forms a dome-shaped cutting surface which is of symmetrical configuration about a center axis of the insert. A crest portion of the cutting surface has a larger radius of curvature than a peripheral portion thereof. The cutting surface can be formed by numerous radii, or can be of constantly varying radius (i.e., elliptical).

8 Claims, 2 Drawing Sheets

DIAMOND-COATED BUTTON INSERT FOR DRILLING

BACKGROUND OF THE INVENTION

The present invention relates to a diamond coated button insert for use in drilling, the insert having a cutting surface which is of symmetrical configuration about a center axis of the insert.

Depicted in FIG. 1 is a conventional drill bit 10 and hammer 12 used in a down-the-hole percussive (DTH) rock drilling method. The drill bit is alternately rotated and impacted by the hammer. The impact provides percussive energy for breaking rock. A top-hammer method is similar to the down-the-hole method, except that the impact is applied at the ground surface rather than by means of a down-the-hole hammer.

In each method the drill bits are usually equipped with buttons 14 which make contact with the rock. The buttons are made of a wear resistant material such as cemented carbide. Although cemented carbide is very wear resistant the buttons tend to wear out much more quickly than is desirable. This is particularly a problem with the gauge buttons 14A which are most exposed. For this reason diamond enhanced cemented carbide buttons are sometimes used, as illustrated in FIG. 2 wherein a diamond layer 16 is applied to the top of the carbide, the diamond layer thus defining a spherical dome surface 16A having a radius of curvature r. The dome surface 16A is of symmetrical configuration with respect to a center axis A of the button.

Diamond has superior wear resistance, but is unfortunately very brittle. One area of weakness is along the outer periphery 16P of the dome. Here the diamond layer is thin and the material has weak points in the diamond and cemented carbide interface. If the outer periphery is in contact with the rock during drilling, the diamond coating has a tendency to spall off. Sometimes a crack forms which causes the entire button to break. To reduce that problem, the dome can be defined by a relatively small radius of curvature, whereby the outer periphery 16P of the dome will be out of contact with the rock, as demonstrated by the button 14' shown in FIG. 3.

However, reducing the radius serves to increase the rate of wear at the crown 16C of the diamond, and increase the susceptibility of the crown to the formation of cracks that can cause the entire button to break. Those shortcomings can be minimized by increasing the dome radius, but then the outer periphery of the dome will contact the rock during cutting, as demonstrated by the button 14" shown in FIG. 4, whereby the tendency for spalling to occur increases, as noted earlier.

It will be appreciated, then, that selecting an "optimum" dome radius has involved a compromise. Typically, the radius of the diamond dome has been selected to be one hundred ten percent (110%) of the radius D of the cylindrical shank 18 of the carbide base.

In lieu of constant-radius domes, it has been proposed to form the crown of a smaller radius than the outer periphery. The drilling rate is thus increased, but so is the wear rate.

Therefore, it would be desirable to provide a button insert of the type having a diamond layer which forms a dome-shaped cutting surface configured symmetrically about a longitudinal axis of the insert, which is highly resistant to spalling and crack formation, and yet exhibits a relatively long life.

SUMMARY OF THE INVENTION

These and other objects of the invention are achieved by a button insert adapted for use in a percussive drill bit. The button insert comprises a base and a diamond layer disposed on an end of the base. The diamond layer forms a dome-shaped cutting surface configured symmetrically about a longitudinal axis of the button insert. The dome-shaped cutting surface is continuously curved and is defined by a larger radius of curvature at a crest portion thereof than at an outer peripheral portion thereof.

The invention also pertains to a percussive rock drill which comprises a drill bit, a hammer for applying axial impacts to the drill bit, and the aforementioned button inserts mounted in the drill bit.

BRIEF DESCRIPTION OF THE DRAWINGS

The objects and advantages of the invention will become apparent from the following detailed description of preferred embodiments thereof in connection with the accompanying drawing in which like numerals designate like elements and in which.

DETAILED DESCRIPTION OF PREFERRED EMBODIMENTS OF THE INVENTION

Figure 1:
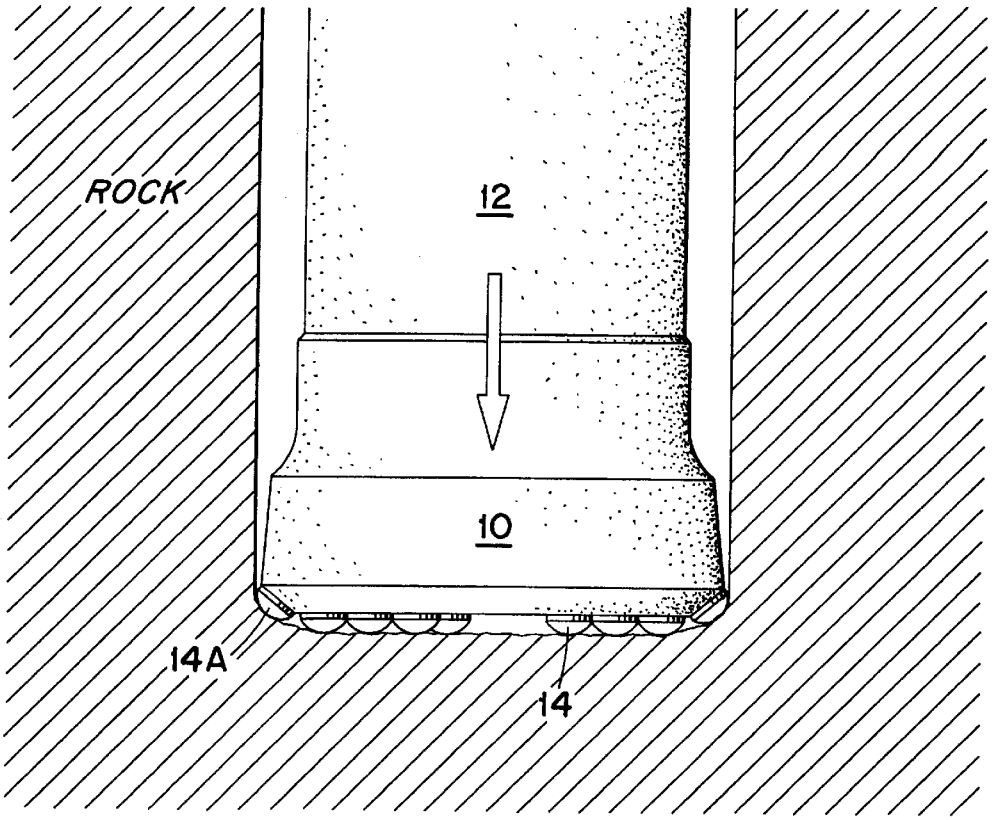
FIG. 1 (PRIOR ART)
FIG. 1 is a side elevational view depicting a conventional percussive drill forming a bore hole in a rock formation.
Figure 2:
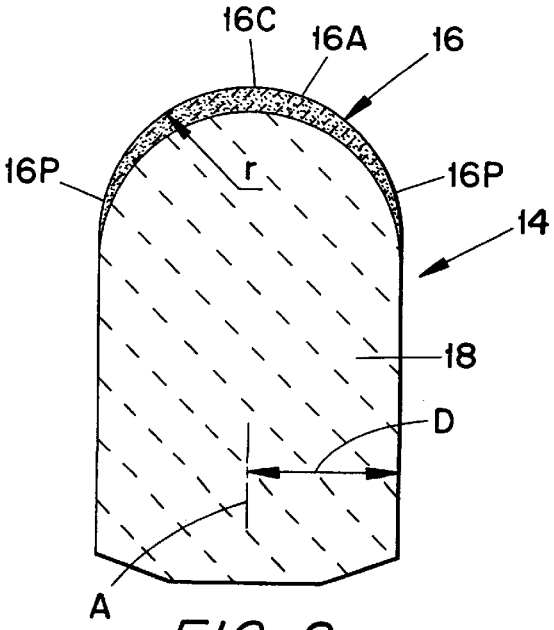
FIG. 2 (PRIOR ART)
FIG. 2 depicts a conventional button insert employed in a percussive drill.
Figure 5:
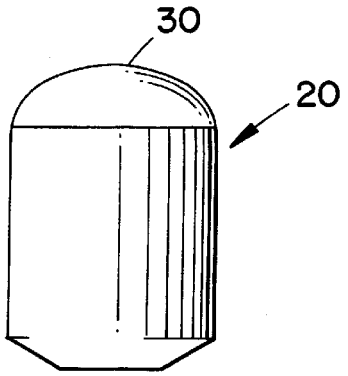
FIG. 5 is a side elevational view of a button insert according to a first embodiment of the present invention.
Figure 5A:
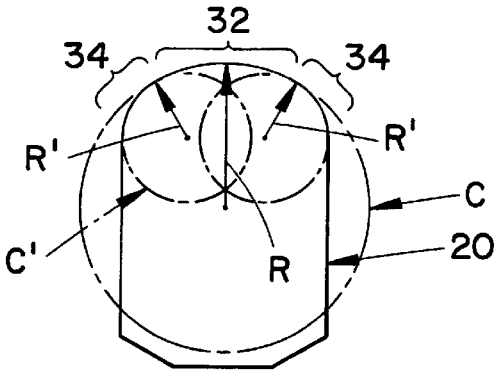
FIG. 5A shows imaginary circles defining the curvatures of the dome of the insert of FIG. 5.
Figure 5B:
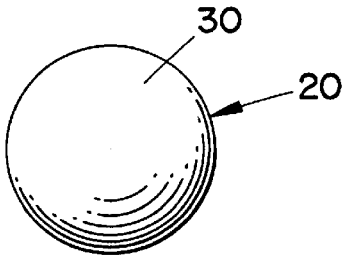
FIG. 5B is a top plan view of the insert depicted in FIG. 5.
Figure 5C:
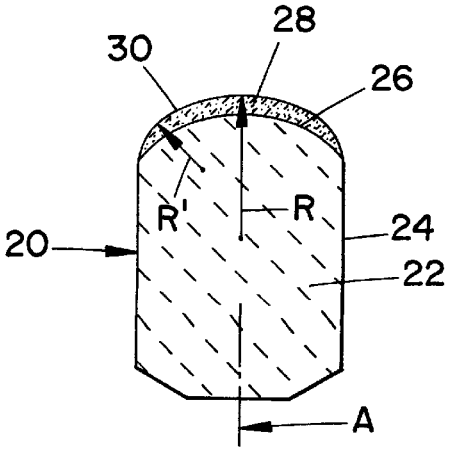
FIG. 5C is a longitudinal sectional view through the insert depicted in FIG. 5.

Depicted in FIGS. 5–5C is a first embodiment of a button insert (i.e., button) 20 adapted for use in a percussion bit, e.g., a bit of the type disclosed in connection with FIG. 1. The button 20 comprises a cemented carbide base 22 having a cylindrical shank 24 and a dome-shaped end face 26A (see FIG. 5C). Bonded to the end face 26 is a layer 28 of diamond, e.g., natural or synthetic diamond.

The diamond layer forms a dome-shaped cutting surface 30 which is of symmetrical configuration with respect to a longitudinal center axis A of the button. That cutting surface is of non-spherical shape in that the radius of curvature R of a crown or upper portion 32 of the surface 30 is larger than a radius of curvature R' of the outer periphery 34 of the surface 30, as shown in FIGS. 5A and 5C. That is, the crown portion 32 is defined by an imaginary circle C of radius R, and the outer periphery 34 is defined by a smaller imaginary circle C'.

Figure 3:
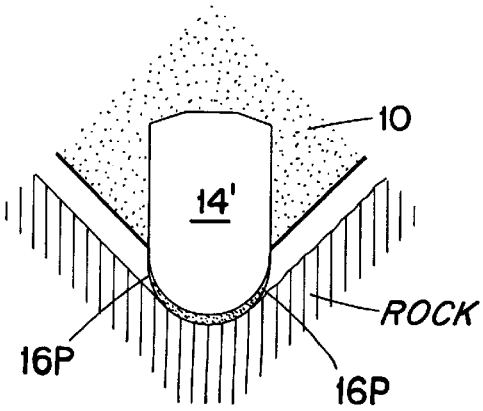
FIG. 3 (PRIOR ART)
FIG. 3 is a schematic view of one type of conventional button insert making a cut in rock formation.
Figure 4:
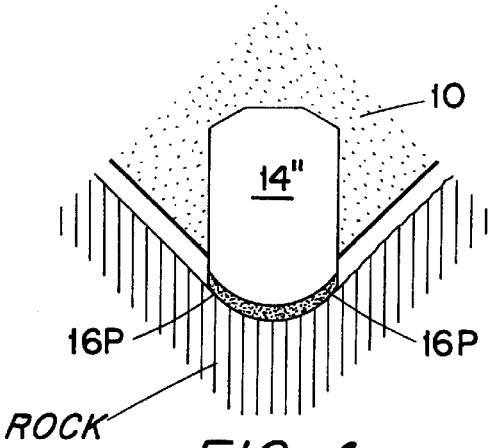
FIG. 4 (PRIOR ART)
FIG. 4 is a view similar to FIG. 3 depicting another type of conventional button insert making a cut in a rock formation.

As a result, the benefits of both of the earlier described prior art buttons (FIGS. 3 and 4) are obtained, without the disadvantages. That is, the smaller diameter R' at the outer periphery means that the outer periphery will be out of contact with the rock during a percussive drilling operation, thereby minimizing spalling. Moreover, the larger radius R at the crown portion means that the crown portion wears at a smaller rate, is stronger and less susceptible to the formation of cracks that could otherwise cause the button to break.

Figure 6:
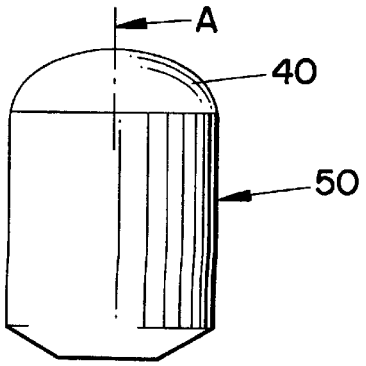
FIG. 6 is a side elevational view of a second embodiment of a button insert according to the present invention.

In lieu of a cutting surface having two different radii as shown in FIG. 5*a*, more than two different radii could be provided. In fact, as depicted in FIG. 6 the dome-shaped diamond cutting surface 40 of a button insert 50 could be of elliptical shape, i.e., of constantly changing radius from the outer periphery of the crown. The same advantages explained above will occur here as well.

It will be appreciated that in accordance with the present invention, a button insert of the type having a cutting surface that is of symmetrical configuration about the center axis, is resistant to spalling and crack formation, and exhibits a reduced wear rate, during percussive drilling.

Although the end face 26 of the carbide base 22 (which forms the interface with the diamond layer) has been depicted as dome-shaped, any suitable shape, such as conical, could be used.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A button insert adapted for use in a percussive drill bit, the button insert comprising a base and a diamond layer disposed on an end of the base, the diamond layer forming a dome-shaped cutting surface configured symmetrically about a longitudinal axis of the button insert, the dome-shaped cutting surface being continuously curved and defined by a larger radius of curvature at a crest portion thereof than at an outer peripheral portion thereof.

2. The button insert according to claim 1 wherein the dome-shaped cutting surface has a constantly varying radius of curvature.

3. The button insert according to claim 1 wherein the base has a cylindrical shank.

4. The button insert according to claim 1 wherein the base is formed of carbide.

5. A percussive rock drill comprising:

a drill bit;

a hammer for applying axial impacts to the drill bit; and button inserts mounted in the drill bit, each button insert comprising a base and a diamond layer disposed on an end of the base, the diamond layer forming a dome-shaped cutting surface configured symmetrically about a longitudinal axis of the button insert, the dome-shaped cutting surface being continuously curved and defined by a larger radius of curvature at a crest portion thereof than at an outer peripheral portion.

6. The drill according to claim 5 wherein the cutting surface has a constantly varying radius of curvature.

7. The drill according to claim 5 wherein the base has a cylindrical shank.

8. The drill according to claim 5 wherein the base is formed of carbide.

* * * * *